United States Patent [19]

Short

[11] B 4,011,087

[45] Mar. 8, 1977

[54] SILVER COMPOSITIONS

[75] Inventor: Oliver Alton Short, Wilmington, Del.

[73] Assignee: E. I. Du Pont de Nemours and Company, Wilmington, Del.

[22] Filed: May 2, 1974

[21] Appl. No.: 466,419

[44] Published under the second Trial Voluntary Protest Program on March 23, 1976 as document No. B 466,419.

[52] U.S. Cl. ..... 106/1; 252/514; 427/96; 427/108; 427/125

[51] Int. Cl.[2] ..... H01B 1/02

[58] Field of Search ..... 106/1; 252/514; 427/96, 427/108, 125

[56] References Cited

UNITED STATES PATENTS 3,849,142 11/1974 Conwicke ..... 106/1

OTHER PUBLICATIONS

Jacobson et al., *Encyclopedia of Chem. Reactions*, vol. 6, 1956, pp. 143, 147 and 150.

*Primary Examiner*—Lorenzo B. Hayes

[57] ABSTRACT

Metallizing compositions useful for printing metal patterns on a glass substrate to make heaters. The compositions comprise silver particles coated with silver halide. They are especially useful for making demisters for auto windshields, since these compositions are more resistant to sulfur attack than are conventional compositions. Also the resultant demisters on glass substrates.

4 Claims, No Drawings

SILVER COMPOSITIONS

BACKGROUND OF THE INVENTION

This invention relates to metallizing compositions and, more particularly, to silver compositions, useful in the electronic arts.

Compositions of finely divided silver and glass powder, dispersed in a liquid vehicle, have been used in the electronic arts for many purposes, including printing thick-film patterns on glass surfaces for subsequent firing to produce automobile windshield demisters. When an electric current is applied to the patterns, the electric current develops heat and thus heats the glass surface. The automotive industry has produced back window demisters or heaters by applying silver stripes on the back window. The silver stripes are connected in parallel relationship and when an electric current is applied, the silver stripes act to remove mist and fog from the back window of the automobile. Typical of art on such silver compositions is my U.S. Pat. No. 3,350,341, issued Oct. 31, 1967, disclosing compositions of silver, vitreous binder and vehicle. Improved silver compositions comprising certain additive salts which have reduced tendency to produce objectionable back-side discoloration when fired on glass (such as auto windshields) include those of my U.S. Pat. No. 3,649,567, issued Dec. 29, 1971.

It has been found by the automotive industry that prior art silver compositions are observed to be deficient when sulfurized neoprene sealant is used to mount windshields in automobiles using the so-called "hot-wire" process. In this process the demister is printed and then fired onto a windshield, after which the windshield is mounted on the automobile with a "rope" of partially cured sulfurized neoprene. The rope of neoprene is melted into the windshield channel by passing current through a wire embedded in the rope. The silver in conventional demister patterns is, during this process, exposed to and attacked by sulfur. A silver composition less susceptible to such attack is desirable.

Neoprene (chlorobutadiene polymer often sulfur modified) is discussed generally in the "Encyclopedia of Polymer Science and Technology," John Wiley, N.Y., 1965, vol. 3, pp. 705–730. Sulfur-modified neoprene is, for example, disclosed in Collins U.S. Pat. No. 2,264,173, issued Nov. 25, 1941.

SUMMARY OF THE INVENTION

This invention provides silver-based metallizing compositions of finely divided silver particles having a silver halide coating, dispersed along with inorganic binder (glass) powder in an inert liquid vehicle. These compositions may be printed on glass substrates to produce patterns which are stable against attack by sulfur both during curing of sulfur-containing neoprene used for mounting windows and during subsequent exposure to heat and humidity. Further, the electrical resistance of the silver pattern can be raised by the use of such silver halide coatings. Silver iodide is the preferred coating.

Also a part of this invention are glass substrates having adherent thereto a sintered thick-film pattern comprising silver halide coated silver particles. The preferred coating comprises silver iodide coated particles.

A further aspect of this invention is a method for coating finely divided silver particles with a silver halide coating, which process comprises agitating a slurry of finely divided silver particles with a solution of halogen selected from the class consisting of iodine, bromine, and chlorine. The time of agitation or contact and the amount of halogen determine the degree of coating. The time of agitation is sufficient to effect formation of such a coating. Preferred processes are those wherein the slurry in an aqueous slurry and that slurry is mixed with a solution of potassium iodide and iodine in water; wherein the slurry is mixed with a solution of iodine dissolved in a volatile organic solvent such as alcohols, ethers, and acetone; wherein said slurry is mixed with an ether solution of bromine; and wherein the slurry is mixed with an aqueous solution of chlorine.

DETAILED DESCRIPTION

The silver iodide coated silver powders used in the present invention may be produced by stirring a slurry of finely divided silver (generally less than 200 mesh and preferably less than 400 mesh) with a solution of iodine. The nature of the liquid media is not critical, so long as the halogen is dissolved in the solvent, permitting chemical attack upon the slurried silver particles. Where the iodine solution is an aqueous solution, KI is used to solubilize the iodine. Where the iodine solution uses an organic solvent such as acetone, ethers or alcohols, of course KI need not be present since iodine dissolves in those organic solvents. The slurry and solution are agitated together for as little as half a minute. Agitation for half an hour normally completes the reaction. The degree of coating is a matter of choice, dependent upon desired properties, and may be varied by varying exposure of the silver particles to halogen, as seen in Examples 1 and 2.

The silver metallizing compositions normally comprise, in addition to silver and inert liquid vehicle, finely divided inorganic binder. The inorganic binder is present to promote adhesion of the metal to the substrate on firing. The chemical nature of the inorganic binder is not critical; the binder is selected according to principles well known in the art dependent upon the final properties desired. Glassy (vitreous) and/or glass ceramic materials may be employed.

The powders are finely divided, i.e., the particles are generally sufficiently finely divided to pass through a 200 mesh screen, preferably a 400 mesh screen (U.S. Standard Sieve Scale). The powders are finely divided to be useful in conventional screen or stencil printing operations, and to facilitate sintering. The compositions are prepared from the solids and vehicles by mechanical mixing and printed as a film on ceramic dielectric substrates in the conventional manner. Any inert liquid may be used as the vehicle. Water or any one of various organic liquids, with or without thickening and/or stabilizing agents and/or other common additives, may be used as the vehicle. Exemplary of the organic liquids which can be used are the aliphatic alcohols; esters of such alcohols, for example, the acetates and propionates; terpenes such as pine oil, terpineol and the like; solutions of resins such as the polymethacrylates of lower alcohols, or solutions of ethylcellulose, in solvents such as pine oil and the monobutyl ether of ethylene glycol monoacetate. The vehicle may contain or be composed of volatile liquids to promote fast setting after application to the substrate.

The ratio of inert liquid vehicle to solids in the dispersions may vary considerably and depends upon the manner in which the dispersion is to be applied and the kind of vehicle used. Generally, from 0.2 to 20 parts by weight of solids per part by weight of vehicle will be used to produce a dispersion of the desired consistency. Preferred dispersions contain 20–75% vehicle.

The compositions are then printed by conventional thick-film printing techniques. By "thick film" is meant films obtained by printing dispersions of powders (usually in an inert vehicle) on a substrate using techniques such as screen and stencil printing, as opposed to the so-called "thin" films deposited by evaporation or sputtering. Thick-film technology is discussed generally in *Handbook of Materials and Processes for Electronics*, C. A. Harper, Editor, McGraw-Hill, New York, 1970, Chapter 11.

The compositions are then fired below the melting point of the silver and glass substrate to sinter or cure the silver pattern and make it adherent to the glass substrate. The actual temperature used is dependent on these melting points, and is dependent on the particular compositions employed and the desired degree of sintering, as will be known to those skilled in the art. Generally, shorter firing times may be employed at higher temperatures.

EXAMPLES

The following examples are given to illustrate the present invention. All parts, percentages, ratios, etc., in the specification and claims are given by weight, unless otherwise stated.

EXAMPLE 1

Two hundred grams of silver powder having an average particle diameter about 1 micron were suspended in 2.5 l. of water. A solution was prepared consisting of 0.2 g. of iodine, 1.0 g. KI and 1200 ml. of water. After the iodine had completely dissolved turning the solution a deep brown color, the $KI/I_2$ solution was poured into the silver suspension and stirring was continued for 30 minutes. The powder was then allowed to settle; the brown color had completely disappeared, indicating that the iodine (or $KI_3$) had reacted with the silver.

The coated silver powder was filtered, washed free of KI and dried. The dry powder was mixed with lead borate glass powder (−325 mesh) and printing vehicle in the following proportions: 70% silver, 10% lead borate, and 20% vehicle (10% ethylcellulose, 90% terpineol).

This paste was used to print a silver pattern which was a line 24 inches long and 0.030 inch wide in a serpentine array on a 4 inch square glass panel. The printed substrate was fired to 625°C. and cooled to room temperature. Resistance was measured and then the panel was tested for chemical resistance to partially cured neoprene by placing the fired panel in contact with a rope of partially cured sulfurized neoprene for 150 hours in a cabinet held at 40°C. and 100% relative humidity. The electrical resistance was again measured after the neoprene test. The electrical and chemical resistance were compared against an identical panel using the same composition except that silver not treated with iodine was used. The silver iodide coated silver of this invention was observed to have a resistance of 1.7 ohms, both before and after exposure to the neoprene, whereas silver not so treated underwent a substantial change in resistance during exposure to neoprene, from 1.2 to 2.0 ohms. Further indication of chemical reactivity of the untreated silver was that exposure to neoprene in the above test caused the pattern to change from silvery white to very dark grey, while the color of the pattern produced according to this invention with silver iodide coated silver remained silvery grey in appearance even after exposure.

EXAMPLE 2

Example 1 was repeated except that 0.5 g. of iodine was used instead of 0.2 g. Results were the same except that resistance was 2.7 ohms before and after the neoprene exposure test.

EXAMPLES 3–5

Silver particles are coated with silver halide by similarly agitating a slurry of silver particles with (a) a solution of iodine dissolved in alcohol, ether, or acetone (no KI need be present), (b) an aqueous solution of chlorine, or (c) an ether solution of bromine.

I claim:

1. In silver metallizing compositions useful for producing silver patterns on glass substrates, said compositions comprising finely divided silver particles and a particulate glass binder dispersed in an inert liquid vehicle, the improvement comprising, as said silver particles, silver-halide coated silver.

2. Compositions according to claim 1 of silver-iodide coated silver particles.

3. A glass substrate having adherent thereto a pattern comprising the composition of claim 1.

4. A substrate having adherent thereto a pattern comprising the composition of claim 2.

* * * * *